United States Patent [19]

Hetherington

[11] Patent Number: 4,664,294

[45] Date of Patent: May 12, 1987

[54] INVENTORY REDUCTION BY DISPLACEMENT

[75] Inventor: Gordon S. Hetherington, Mississauga, Ontario, Canada

[73] Assignee: Petro-Canada Inc., Toronto, Ontario, Canada

[21] Appl. No.: 773,729

[22] Filed: Sep. 6, 1985

[51] Int. Cl.[4] ..... B65D 35/56

[52] U.S. Cl. ..... 222/105; 222/386.5; 220/1 B; 220/85 B

[58] Field of Search ..... 220/1 B, 85 R, 216, 220/85 B; 222/92, 94, 105, 130, 183, 319, 373, 386.5

[56] References Cited

U.S. PATENT DOCUMENTS

| | | | |
|---|---|---|---|
| 2,924,350 | 2/1960 | Greer | 220/216 X |
| 3,275,197 | 9/1966 | Eklund | 222/386.5 X |
| 3,385,477 | 5/1968 | Chevalaz | 222/386.5 X |
| 4,060,175 | 11/1977 | Rysgaard, Sr. | 220/85 |
| 4,318,348 | 3/1982 | Parsons et al. | 105/358 |
| 4,461,402 | 7/1984 | Fell et al. | 222/105 |
| 4,573,508 | 3/1986 | Knaus | 150/55 |

FOREIGN PATENT DOCUMENTS

19009/83 9/1983 Australia .

*Primary Examiner*—Joseph J. Rolla
*Assistant Examiner*—Michael S. Huppert
*Attorney, Agent, or Firm*—Rogers, Bereskin & Parr

[57] ABSTRACT

An apparatus is disclosed for displacing a portion of liquid stored in a tank using impervious bladders formed with flexible membranes. The bladders are filled with material having a density greater than the density of the stored liquid and cover substantially the entire usuable bottom of the tank. The tank bottom also has unusable areas including inflow pipes, outflow pipes, heaters, support columns or floating roof support legs. Substantially rigid protectors are provided preventing the bladders from expanding into the unusable areas of the tank bottom.

19 Claims, 9 Drawing Figures

Figure 1:
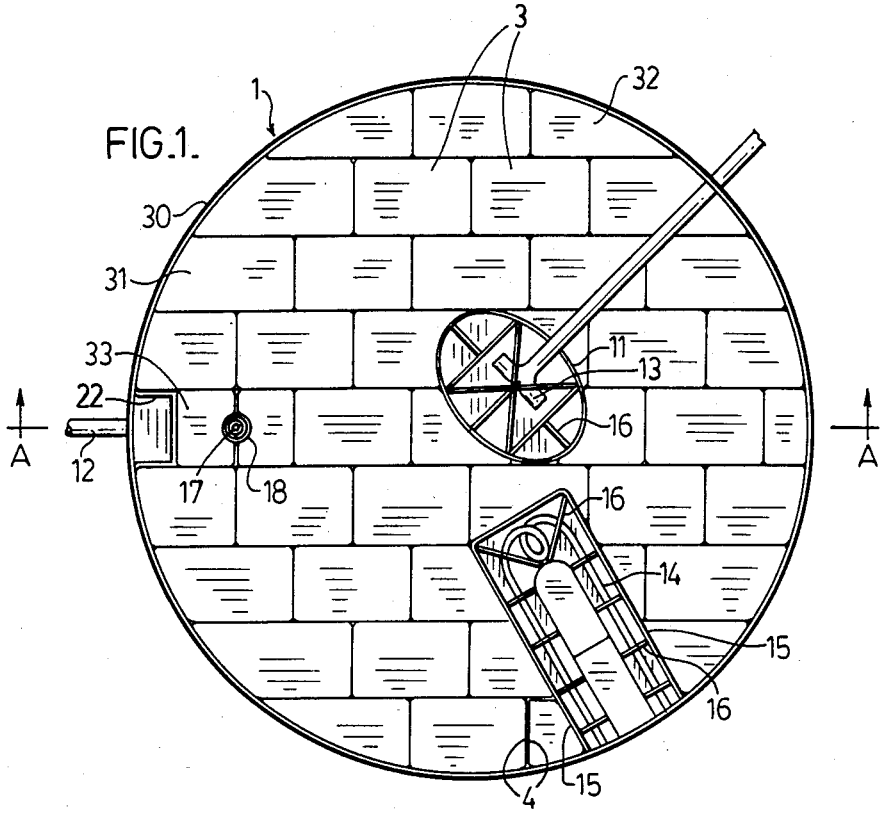

FIG.3.
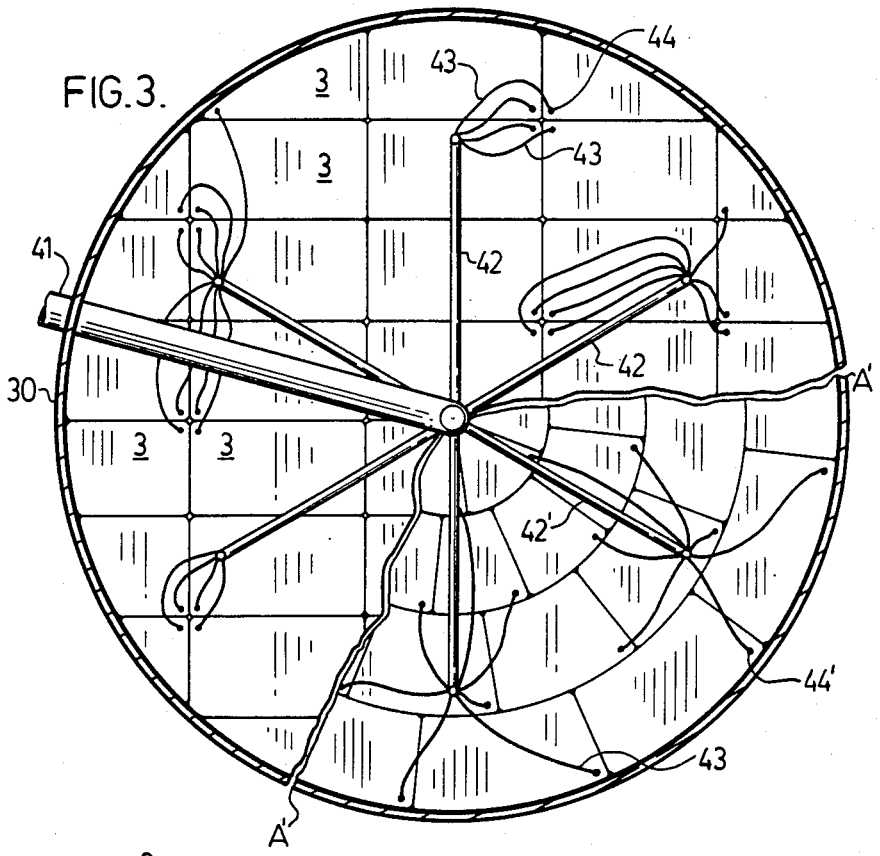
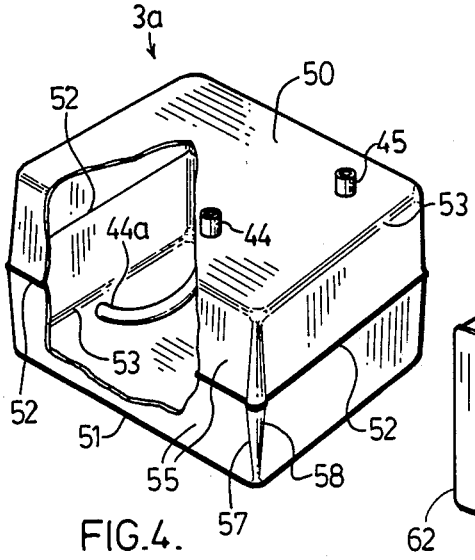
FIG.4.
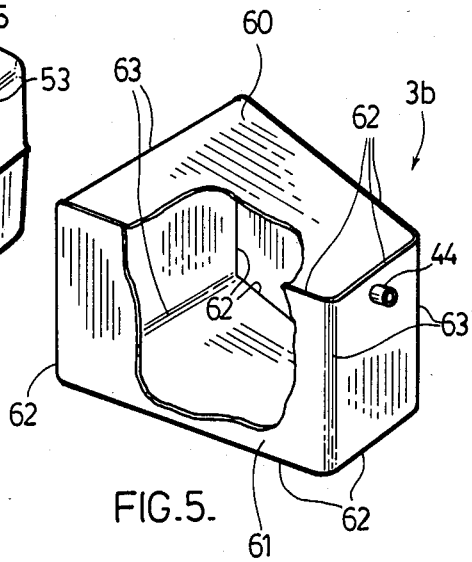
FIG.5.

INVENTORY REDUCTION BY DISPLACEMENT

The present invention relates to fluid storage tanks, and in particular to an apparatus for displacing inventory of a stored liquid in such storage tanks.

In conventional storage tanks, particularly for crude petroleum and petroleum products, the tank bottom surfaces are generally constructed in a substantially flat shape. The inflow and outflow (suction) pipes are conventionally placed about 0.3 to 0.8 meters above the bottom of the tank, and therefore are not able to draw off the entire inventory of stored liquid. As the cost of crude petroleum and products continues to escalate, the inventory that is thus unavailable to be pumped represents an ever-increasing value. Furthermore, the cost of working capital required to maintain that inventory escalates as well. This problem is particularly acute in existing tankage, where the cost of modifying the tank and/or fittings to draw off a higher proportion of the total inventory may be prohibitive. In addition, in tankage containing a floating roof for prevention of vapour loss, the roof is equipped with legs designed to support the roof when the tank is taken out of service; such legs are typically at least 1.3 meters in height in order to enable personnel to move under the roof for cleaning purposes and to provide clearance for heaters, agitators, piping and other apparatus at the bottom of the tank. Therefore, the inventory of liquid in the tank must be a least 1.3 meters deep in order to utilize the vapour-containing feature of the floating roof.

In the past, attempts have been made to reduce liquid inventory by displacing it with a denser liquid, for example displacing petroleum products with water or by displacing crude petroleum with salt/water solution. Both water, and to a greater extent salt/water, have caused corrosion problems in tankage. Although corrosion can be largely prevented by appropriate interior tank coatings, there remains the problem that heating and agitation cannot be properly carried out in conventional tanks where the heaters and agitators are generally placed within 1 meter of the bottom of the tank, because of the problem of mixing the displacement liquid with the stored liquid. Further, there is the potential difficulty of contaminating fuel products with water, which is undesirable.

The present invention provides an apparatus for displacing inventory of stored liquid in a tank having a wall and a substantially horizontal bottom, comprising a plurality of impervious bladders, each bladder comprising:

(a) flexible top, bottom and wall membranes, and (b) means for filling said bladder with flowable displacement material of greater density than said stored liquid, said bladders being disposed to cover substantially the entire usable bottom of said tank.

The tank bottom comprises unusable areas including at least one of inflow pipes, outflow pipes, headers, support columns and floating roof support legs and substantially rigid protector means are provided preventing the bladders from expanding into the unusable areas.

Figure 2:
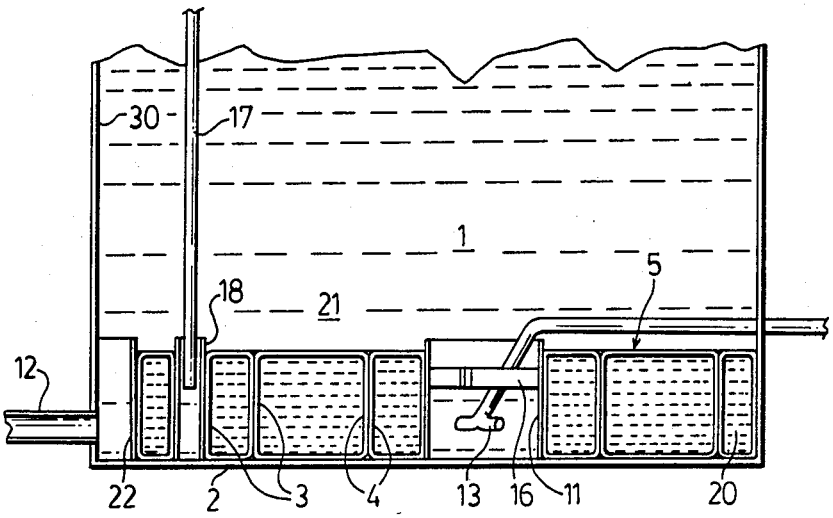
Figure 6:
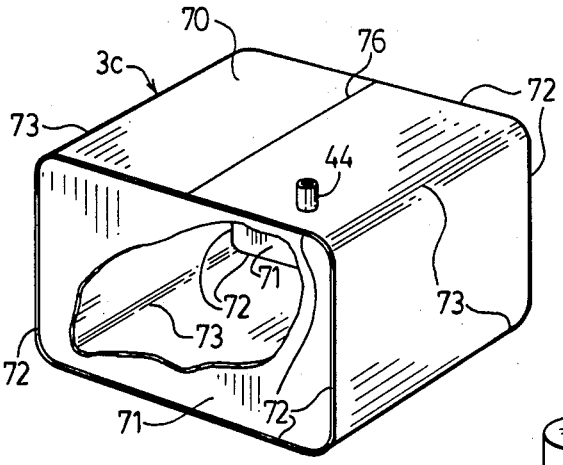
Figure 7:
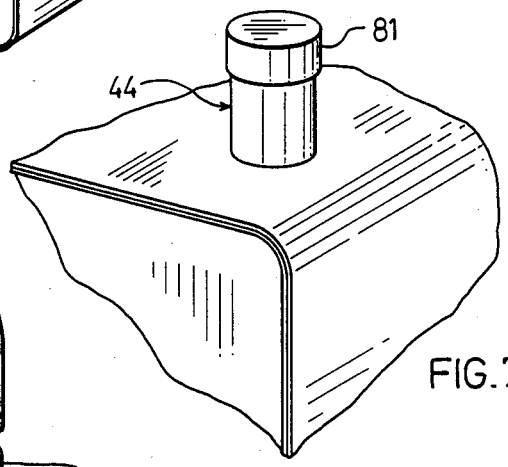
Figure 8:
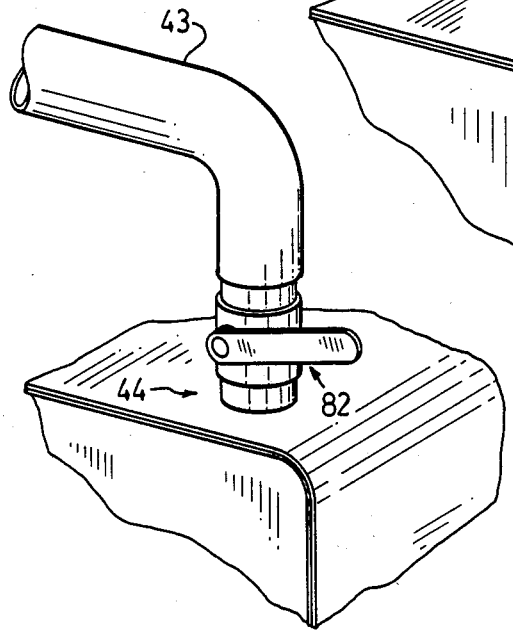
Figure 9:
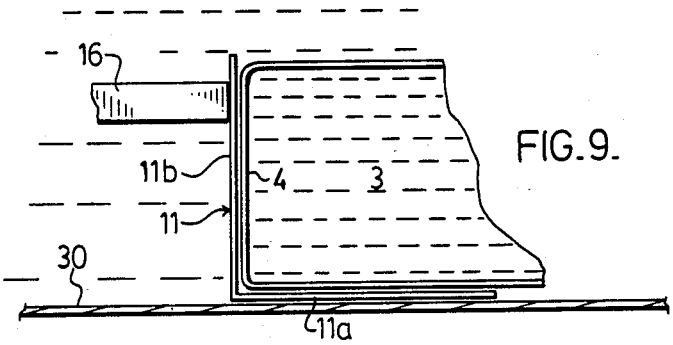

In drawings depicting a preferred embodiment of the invention:

FIG. 1 illustrates in plan view the interior of a liquid storage tank having displacement bladders positioned according to the invention, FIG. 2 shows an elevation in partial cross-section through A—A of FIG. 1, FIG. 3 is a plan view of a tank filled with bladders and portions of a filling manifold according to one embodiment of the invention, FIG. 4 is an orthogonal projection in partial cutaway of a bladder in pillow form according to another embodiment of the invention, FIG. 5 is an orthogonal projection in partial cutaway of a bladder in wrapped rectangular form, FIG. 6 is an orthogonal projection in partial cutaway of a bladder in semi-cylindrical form having end walls, FIG. 7 is an expanded partial view of one form of a bladder fill tube adaptable to operate in conjunction with the invention, FIG. 8 is an expanded partial view of a second form of a bladder fill tube, and FIG. 9 is an expanded partial sectional view of a bladder and rigid retaining wall along part of A—A of FIG. 1.

In this specification including claims, the usable tank bottom is defined as that area of the bottom that is available to be covered with displacement bladders without interference with the operation of tank fittings.

In a preferred embodiment of the invention as illustrated in FIGS. 1 and 2, several bladders 3 of generally rectangular horizontal cross-section and approximately equal height are positioned on the bottom surface 2 of liquid storage tank 1 in a manner such that the walls 4 of each bladder will be contiguous in the inflated mode with the walls 4 of each adjacent bladder. Several of the bladder walls 4 are shown separately for clarity, but obviously they are in contact where bladders 3 are filled. Thus for practical purposes, the bladders when inflated with displacement material 20 (FIG. 2) form a substantially continuous raised bottom 5 in tank 1. It is desirable for maximum displacement of valuable inventory 21 that the inflated bladders 3 cover the entire usable area of tank bottom surface 2, although complete bottom coverage is not essential for all applications of the invention.

In order to prevent interference with interior tank fittings, for example outflow pipe 12, inlet pipe 13 and heater coils 14, the surfaces of bladders 3 are restrained in a suitable position away from such fittings. A convenient method is to employ substantially rigid retaining walls 11, 15, 18 and 22. These walls can be optionally fixed to tank bottom surface 2 to provide controlled clearance with respect to tank fittings, and where necessary bracing 16 can provide support to prevent collapse of the retaining walls in the event that bladders 3 are filled with displacement material 20 while the tank is empty of stored material. Retaining walls 11, 15, 18 and 22 are advantageously higher than the wall height of bladders 3, in order to prevent contact of bladder material with top edges of the rigid walls, and to minimize potential wear of the bladder membranes. Optionally, one or more weirs of any convenient shape can be provided in the tops of the retaining walls to aid spillover of valuable inventory 21 into the spaces around the tank fittings, especially around outlet pipe 12. Other tank fittings that can be provided for, which for the sake of clarity are not shown, include agitators, floating roof legs, and ground cables and other items. The bladders can be allowed to contact some interior non-movable tank fittings, for example roof support columns, where such contact does not tend to damage the bladders. Where the fitting falls at the wall lines 4 of adjacent bladders, it may be possible to employ normal rectangular bladders in lieu of custom-cutting them. The person skilled in the art can readily determine such needs from an assessment of the individual tank interior.

The bladders are constructed of flexible membrane which is impervious to and not degraded by both displacement material 20 and stored liquid 21. Any appropriate membrane can be used, for example non-woven scrim or woven cloth of flexible fibre, for example polyester, coated or impregnated with suitable resin, for example polyamide resin, or a fuel-resistant polyvinyl chloride compound. Alternatively, the membrane can comprise unreinforced thermoplastic material, for example blown film, of sufficient thickness to have appropriate tear strength and puncture resistance. Seams, where needed, may be fashioned by appropriate means known to those skilled in the art, for example dielectric or heat sealing. The bladders may be of any suitable shape; it is desirable for ease of bladder construction and assembly to fabricate the majority of bladders in the same size and shape, a convenient shape being rectangular in plan and in cross-section. Alternatively, bladders can be positioned in a radial layout in a circular tank; the bladders in the inner ring would take the form of sectors of a circle, and in mid and outer rings would be in the shape of truncated sectors, discussed hereinafter with reference to FIG. 3, lower portion below A'—A', and to FIG. 5 showing an individual bladder. The size of the bladders is selected in relation to the particular installation requirements, including the tank size, the number of fittings, the weight of the individual bladders and the size of manways through which the bladders are individually introduced into the tank; a convenient size is 1 to 1.5 meters in width by 2 to 3 meters in length. Thus the number of bladders is determined from their size and the tank size. The height of the bladder is generally chosen to optimize the amount of stored material displaced and is usually selected so as to bring raised bottom 5 up to a level slightly above outflow pipe 12. In many existing petroleum storage tanks, a floating roof is installed in order to prevent evaporation loss of the inventory of stored material and consequent pollution problems. Such roofs float on stored material when the inventory is sufficient, and rest on legs when the level of inventory in the tank is below the level of the legs. The bladders require clearance beneath the floating roof, and consequently the maximum height of the bladders is slightly less than that of the floating roof when supported on its legs; however, in principle, the bladders could be made of indefinite height up to at least 3 meters if required. Some of the bladders, for example non-uniform bladders 31, 32, and 33, are constructed of appropriate shape to fit the space available adjacent tank walls 30 and adjacent interior tank fittings, for example floating roof legs 17. Such shapes include trapezoidal bladder 31 and triangular bladder 32 whose shapes can be easily determined by the skilled practitioner and fabricated by appropriate cutting of the membranes prior to seam construction. In most large tanks the curvature of wall 30 will be sufficiently large to permit adjacent bladders to have straight outside edges rather than curved edges. However, as noted above, bladders can be custom-cut to any desired shape. The required properties of the membrane material and seam construction include flexibility, imperviousness to the displacement material and storage material as noted above, and sufficient abrasion and tear resistance to prevent damage by irregularities on the interior tank walls 30 and tank bottom 2 and rigid walls 11, 15, 18 and 22 during initial filling and normal operation of the storage tank 1. Because there is very little stress on the bladder membranes when all bladders are filled to the same level, generally the absolute strength of the members need not be high. When equally filled, the individual bladders will assume their preferred shape, and there will be little bulging of the membrane walls, top or bottom except as required to accommodate the irregularities in the tank and rigid walls as noted above. The bladders are advantageously filled simultaneously so as to maintain during the filling operation a uniform level of displacement material 20 across the raised bottom 5 throughout the filling operation. Advantageously, manifolding and tubing can be incorporated temporarily or permanently attached to each bladder in order to maintain equal fill rates for all bladders. Should any bladder achieve a level of displacement material higher than other bladders during the filling, the flow of displacement material will operate against a higher pressure head and have the effect of slowing the flow rate into that bladder and automatically equalizing the levels of displacement materials 20. Alternatively, flow meters can be used to ensure equalized filling of the bladders.

Preliminary to introduction of the bladders 3, retaining walls 11, 15, 18 and 22 are positioned to protect the tank fittings and are appropriately fixed to the tank bottom. In some cases the retaining walls may alternatively or additionally be fixed to the tank fittings. The method of fixing may be selected as appropriate to the particular installation, for example welding or applying of adhesives. Preferably, retaining walls 11, 15, 18 and 22 comprise a vertical portion **11*b* providing the restraint to prevent collapse of the bladder wall 4 and a bottom horizontal portion 11*a* resting on tank bottom surface 30, upon which the bladder 3 rests as illustrated in FIG. 9. Retaining walls can be of unitary construction as, for example, metal plate of suitable thickness, or alternatively can be fabricated, including for example a rigid frame and sheet material secured to the frame. Brace 16 prevents bending or collapse of the retaining wall. In some cases, the provision of horizontal portion 11*a* can lend sufficient support to the retaining wall that fewer braces 16 will be required, particularly when the retaining wall is curved. Because a primary use of the bladders and method of the invention is in existing storage tanks, it is advantageous to be able to introduce the bladders through existing manways in the tanks. The bladders are empty when introduced into the tank through a manway, and conveniently can be in a folded, rolled condition; the bladders are brought into position and unrolled so that the bottom membrane is flat on the tank bottom and its edges are contiguous with the edges of the adjacent bladder bottoms. When all bladders are positioned inside the tank and all fill tubing and manifolding attached, the filling procedure is initiated and the raised bottom 5, which is essentially the top membrane of the bladders 3, is brought up to the desired height, which is preferably substantially the same as the height of the bladder walls 4**, but which may be slightly less or greater than the bladder walls if desired.

Displacement material 20 must be denser than the stored liquid 21. Where the stored liquid is a petroleum product having a density of less than 1 g/ml, the density of water is sufficient to cause the filled bladders to underlie the petroleum product. It is possible to use a flowable solid as the displacement material, provided it has a bulk density greater than the stored liquid. Preferably the flowable displacement material is a liquid, and more preferably an aqueous liquid, optionally containing a freezing point depressant if sub-freezing temperatures will be encountered. Organic antifreeze can be used, for example ethylene glycol; inorganic freezing point depressants such as salts are preferred because of greater density than ethylene glycol solutions and in particular because inorganic salts are usually less costly than organic materials. Suitable inorganic salts for use with the invention include chlorides, sulphates and carbonates of sodium and potassium, calcium chloride, and magnesium chloride and sulphate. Chlorides can cause corrosion in many metals, and thus in many applications, a particularly preferred salt is magnesium sulphate due to its lower corrosivitiy than chlorides. Phosphates, unless inhibited with bactericide, should be avoided because they can contribute to bacterial growth.

FIG. 3 depicts a tank bottom in plan view covered with bladders according to the invention, and one form of fill manifolding that can be used with the bladders. Main fill tube 41 enters tank wall 30 through a manway (not shown) and communicates with secondary fill tubes 42. A convenient number of secondary fill tubes 42 is six, although any suitable number may be used. These communicate with tertiary fill tubes 43 which in this embodiment are connected to the bladders 3 at bladder fill tubes 44. When displacement fluid is introduced through main fill tube 41, it flows through all secondary and tertiary tubes, thus filling all bladders substantially simultaneously.

In FIG. 4 is shown a pillow-shaped bladder 3*a* according to one form of the invention, in the shape that it assumes when filled inside a tank and in contact with other bladders on all sides. Top membrane 50 and bottom membrane 51, which are flat when the bladder is deflated, are sealed at edge seams 52. Alternatively, a single membrane can be folded to provide top and bottom membranes with seams 52 on three sides of each bladder. Displacement material is introduced through bladder fill tube 44. As the bladder is filled simultaneously with adjacent bladders, the top membrane 50 rises and rolled edges 53 begin to appear and wall portions 55 begin to form, from flat top membrane 50 and bottom membrane 51. Thus although bladders 3*a* have no apparent wall portions when deflated, the wall portions 55 are formed during the inflation, i.e. filling, step. At the same time, folds 57 develop at corners 58 of the bladders 3*a*, allowing adjacent bladders 3*a* to cooperate in order to cover substantially the entire tank bottom. Bladder fill tube 44 is preferably so placed that it remains accessible when bladders 3*a* are filled, for example on the top surface near edges 53. Thus if primary, secondary and tertiary fill tubes 41, 42 and 43 (FIG. 3) are left in place while the bladders and tank are in service, they will rest on top of the inflated bladders. If desired, bladder fill tubes 44 can alternatively be positioned on the sides 55 of the bladders 3. In that case, primary, secondary and tertiary fill tubes 41, 42 and 43 can be positioned along the intersections of bladders 3, and when bladders 3 are inflated, the fill tubes 41, 42, 43 remain between adjacent bladders 3 and are not subject to scouring by stored fluids when the tank is in service. However, the placement of bladder fill tubes 44 is not critical and the bladders will function in the invention with any appropriate placement of fill tubes. Optionally, bladder fill tubes 44 can extend inside the bladders sufficiently far that the inside openings 44*a* of the tubes rest at the bottom of the filled bladders 3. Optionally, a vent tube 45 can be provided at a high point in the upper surface of bladders 3 for venting of air that may be present in the bladders before or during filling.

In FIG. 5 is illustrated an alternative construction of bladders 3*b* with pre-formed wall sections. The bladder 3*b* is constructed of two U-shaped membranes 60 and 61 which are joined at seams 62, the seams 62 also forming eight of the twelve edges of the solid bladder. Four edges 63 are formed by the bending of each membrane 60 and 61. Bladder fill tube 44 is shown in an optional position on wall portion of membrane 61. It was indicated hereinabove that bladders can optionally be positioned in a radial layout, individual bladders being in the form of truncated sectors of a circle. Although bladder 3*b* can readily be rectangular in shape, it is shown for illustrative purposes in FIG. 5 as a truncated sector in plan, one end being wider than the other for fitting into the radial layout of FIG. 3, portion below A'—A'. It will be apparent to the person skilled in the art that in a large diameter tank, bladders in the rings spaced apart from the centre will have such small taper that they will be very nearly rectangular; and in those places, rectangular bladders could be used, because the flexibility of the membrane will compensate for small irregularities in the required shape.

FIG. 6 shows another alternative construction of bladders 3*c* in which membrane 70 is formed into a continuous tube of generally rectangular cross-section. Optional seam 76 is used where the tube is formed of flat, rolled membrane material. End membranes 71, generally rectangular in shape, are attached to membrane 70 at seams 72 which form eight of the twelve edges of the bladder 3*c*. Curved portions 73 form the remaining four edges. Bladder fill tube 44 is shown on the upper surface of the bladder in this embodiment.

Referring now to FIG. 7, one embodiment of bladder fill tube 44 is shown positioned on top of the bladder. Cap 81 seals tube 44 and consequently seals the bladder against loss of the displacement material; cap 81 is preferably attached to fill tube 44 by threading, although any suitable attachment method can be used. The alternative construction of FIG. 8 includes bladder fill tube 44 to which is connected valve 82 and in turn, tertiary fill tube 43. The construction of FIG. 8 is especially suitable when the fill tubes 43 are to be left in place when the tank goes into service, as valve 82 prevents loss of displacement material and transfer of material between bladders 3 while the tank is in service. Bladder fill tube 44 can be made partially of flexible material, so that it can be folded generally flat against the bladder after being filled.

The person skilled in the art will appreciate that the bladders must be fluid-tight; a convenient method of ensuring fluid-tightness will be to pressure test the bladders under low pressure prior to introducing them into the tank, thus ensuring that the displacement material and stored material are not allowed to mix.

What is claimed is:

1. Apparatus for displacing inventory of stored liquid in a tank having a wall and a substantially horizontal bottom, comprising a plurality of impervious bladders, each bladder comprising:

(a) flexible membranes forming top, bottom and wall portions, and (b) means for filling said bladder with flowable displacement material of greater density than said stored liquid, said bladders being disposed to cover substantially the entire usuable bottom of said tank;

wherein said tank bottom comprises unusable areas, said unusable areas including at least one of inflow pipes, outflow pipes, heaters, support columns and floating roof support legs, and wherein substantially rigid protector means are provided preventing said bladders from expanding into said unusable areas.

2. Apparatus as claimed in claim 1, further comprising means for filling a plurality of bladders in said tank substantially simultaneously.

3. Apparatus as claimed in claim 2, wherein said means for filling simultaneously comprises tubing and manifolding adapted to distribute said displacement material among said plurality of bladders.

4. Apparatus as claimed in claim 3, wherein said filling means comprises fill tubes fixed to and communicating with said bladders and provided with closure means permitting substantially permanent reopenable closure of said fill tubes.

5. Apparatus as claimed in claim 4, wherein said closure means is a cap.

6. Apparatus as claimed in claim 4, wherein said closure means is a valve.

7. Apparatus as claimed in claims 1, 5 or 6, wherein said fill tube extends to the bottom interior of said bladders when filled.

8. Apparatus as claimed in claim 1, 3 or 4, further vent means communicating with said bladders and adapted to allow the exit of vapours from said bladders during or after filling.

9. Apparatus as claimed in claim 1 wherein said protector means comprise substantially vertical rigid walls.

10. Apparatus as claimed in claim 9 wherein said protector means have a lower portion adapted to rest on said tank bottom under said bladders.

11. Apparatus as claimed in claim 1 wherein said protector means comprise a flexible sheet secured to a substantially rigid frame.

12. Apparatus as claimed in claim 1 wherein at least some of said bladders are shaped in plan to substantially fully contact said tank walls.

13. Apparatus as claimed in claims 1 or 12 wherein at least some of said bladders are substantially triangular in plan.

14. Apparatus as claimed in claim 1 wherein at least some of said bladders are shaped in plan as truncated sectors of a circle.

15. Apparatus as claimed in claim 1 wherein said flowable displacement material is salt/water solution.

16. Apparatus as claimed in claim 15 wherein said salt is magnesium sulphate.

17. Apparatus as claimed in claim 1, wherein said top, bottom and wall membranes comprise membranes in pillow shape.

18. Apparatus as claimed in claim 1, wherein said top, bottom and wall membranes comprise a continuous rectangular membrane and end membranes adapted to close said rectangular membrane.

19. Apparatus as claimed in claim 1, wherein said top, bottom and wall membranes comprise a three-sided membrane adapted to co-operate with a second three-sided membrane in order to form a substantially rectangular hollow bladder.

* * * * *